United States Patent [19]

Townsend et al.

[11] Patent Number: 4,754,683

[45] Date of Patent: Jul. 5, 1988

[54] HIGH TENSION DRUMHEAD

[75] Inventors: David J. Townsend, Canoga Park; Robert B. Carson, Van Nuys, both of Calif.

[73] Assignee: Remo, Inc., North Hollywood, Calif.

[21] Appl. No.: 873,054

[22] Filed: Jun. 4, 1986

Related U.S. Application Data

[63] Continuation of Ser. No. 572,569, Jan. 19, 1984, abandoned.

[51] Int. Cl.[4] ..... G10D 13/02

[52] U.S. Cl. ..... 84/413; 84/411 R

[58] Field of Search ..... 84/411–420

[56] References Cited

U.S. PATENT DOCUMENTS

| | | | |
|---|---|---|---|
| 2,425,996 | 8/1947 | Cordes | 84/411 A |
| 2,934,989 | 5/1960 | Belli et al. | 84/414 |
| 4,218,952 | 8/1980 | Arbiter | 84/411 A |
| 4,520,709 | 6/1985 | Kester | 84/415 |

*Primary Examiner*—Lawrence R. Franklin

*Attorney, Agent, or Firm*—Lyon & Lyon

[57] ABSTRACT

The material constituting a drumming surface is anchored at its perimeter with epoxy to a supporting hoop. Between the hoop and tightening means there is located an O-ring of tension increasing material. When the tightening means is urged downwardly to increase the tension on the drumming surface, the tension increasing material distorts, partly laterally, thereby creating a tension which substantially increases the relative tension of the drumming surface material.

11 Claims, 1 Drawing Sheet

HIGH TENSION DRUMHEAD

This application is a continuation of application Ser. No. 572,569 filed Jan. 19, 1984, now abandoned.

BACKGROUND OF THE INVENTION

The present invention relates to drums. More particularly the invention relates to drum heads which have a relatively high tension of the drumming surface.

In the prior art, devices are known for adjusting the pitch of the drum by varying the tension on the drumhead. For instance there are devices wherein a mechanism is used to stretch the drumhead by rotation of a drum shell about a central axis support which acts to put increased tension on the hoop supporting the drumming surface material. This increase in pressure can be effected by a pedal assembly or by rotating the drum shell.

In another procedure of the prior art the perimeter of the drumming surface which is anchored to a hoop by epoxy located in a slot in the hoop is urged downwardly away from the drumming surface by a tightening element surrounding the perimeter of the drum shell. Increase in tension is effected by forcing the hoop downwardly around the drum bearing edge of the drum, and the further this is forced away the higher the tension. This can only be effected until such time as the metal hoop is distorted in shape or the epoxy cracks or escapes, whereafter the tension cannot be uniformly increased on the drumming surface. The restriction of this prior art procedure is that the tension can only be increased to a relatively low force before distortion takes place. Furthermore the tightening process is a time consuming process since the stretching of the drumming surface material must be effected slowly so as to effect uniform increase in tension without destroying the drumming surface material. It is accordingly a labor intensive and costly procedure for increasing tension on the drumming surface.

SUMMARY OF THE INVENTION

According to the present invention there is provided a drumhead with a material for constituting a drumming surface. The perimeter of the surface is anchored to a supporting hoop means by epoxy means which is located within a slot around the hoop means. Provided at least partly about the hoop means is a tension increasing material for location between the hoop means and the tightening element such that as the tightening element is moved in a direction transverse to the drumming surface to force the hoop means and tensioning material away from the drumming surface tension in the drumming surface material is caused to increase relatively substantially.

The tension increasing material is in the form of an O-ring which is selected from a linear polyethylene or polypropylene or neoprene or other similar materials having a hardness between 50 Duro and 100 Duro, and with this arrangement the tension imparted to the drumming surface is in the range of 500 psi to 8,000 psi.

The distortion of the O-ring due to flattening against the drumming surface material causes increased tension to be imparted to the drumming surface material. This flattening also acts as a seal blocking the epoxy from escaping between the hoop means and the drum shell.

DETAILED DESCRIPTION OF THE INVENTION

Figure 1:
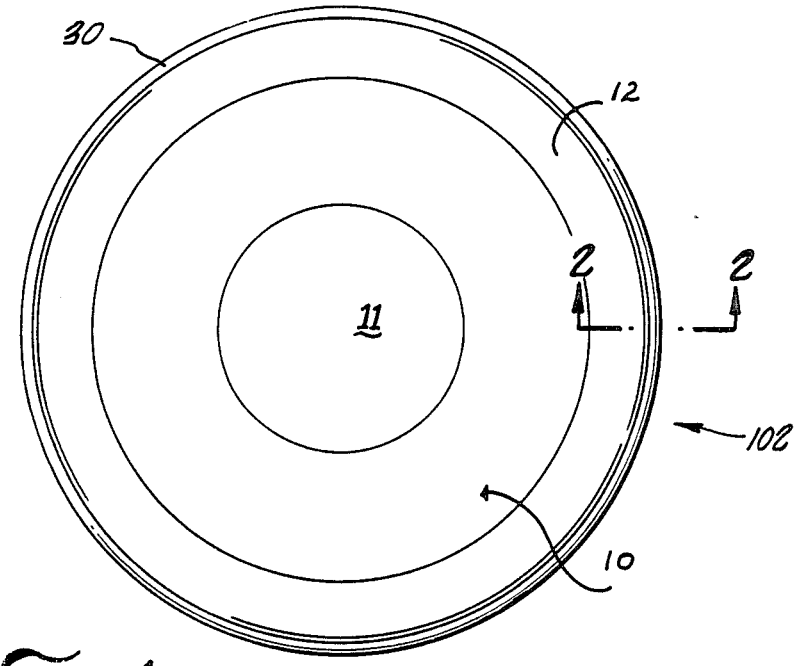
FIG. 1 is a plan view of the top of a drum head illustrating the drumming surface and the tension increasing material positioned about the perimeter of the drumming surface.

A drumhead includes a drumming surface 10 in the center of which is a reinforcement portion 11. Around the perimeter of the drumming surface 10 is a different (muffling) surface 12 from the drumming surface, and beyond the circular surface 12 the perimeter of the drumming surface 10 is anchored to a supporting hoop means 13 which is also commonly referred to as a flesh hoop.

The supporting hoop means 13 is constituted by a ring-like formation with a slot 14 into which is placed epoxy means 15. The free end 16 of the perimeter of the drumming surface material is securely anchored to the hoop means 13 by the epoxy means 15. The inside plane 17 of the drumming surface 10 is located circumferentially near its perimeter at 18 on the top edge 19 of a drum shell 20. At 18 the drumming surface 10 is bent downwardly to form a skirt 21 which surrounds the drum shell 20 and the free end 16 of which fits within the supporting hoop 13 which itself is located about the drum shell 20.

Figure 3:
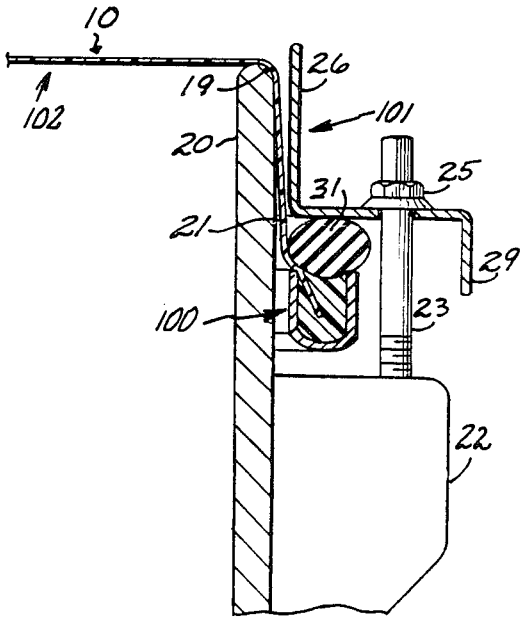
FIG. 3 is a sectional side view similar to FIG. 2 illustrating the tensioned state of the drumming surface.

About the drum shell 20 there is a foundation pillar 22 which extends outwardly from the drum shell 20 so as to receive a tension bolt 23 which together with a plate member 24, which is also commonly referred to as a couterhoop, and nut 25 constitute a tightening element for tensioning the drumhead. Plate 24 is in the form of a ring having a vertical section 26, a horizontal section 27 with an aperture 28 through which the shaft 23 passes and a depending lip 29. Between the tightening element and the supporting hoop means 13 there is located a tension increasing material 30 which is in the form of an O-ring and substantially completely surrounds the perimeter of the drumming surface 10. The tension increasing material 30 may be constituted by a cylindrical elongated strip which is cut substantially to form the shape of a ring for location about the perimeter to the drumhead. The O-ring 30 is located on top of the epoxy 15 which is at the mouth of the slot 14 of the supporting hoop means. In the untightened position the O-ring has a substantially circular cross-section. As the tightening element is drawn downwardly toward the support structure 22 the cross-section of the O-ring 30 is deformed to a flatter shape over the mouth of the slot as indicated in FIG. 3 by numeral 31.

Figure 2:
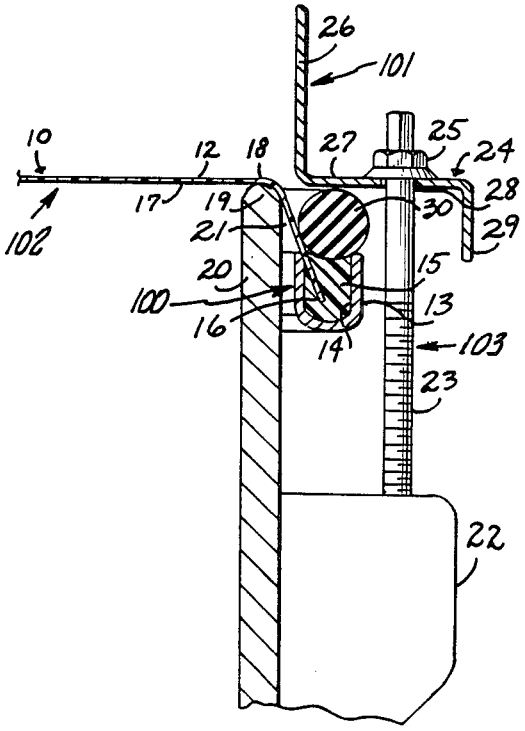
FIG. 2 is a sectional side view of a drumhead taken along line 2—2 of FIG. 1 and illustrating the drumhead of the present invention and including one of the drum tightening apparatus for use with the present invention, the Figure. showing the relatively non-tensioned state of the drumming surface.

Drawing the tightening element downwardly onto the support member 22 by turning the nut 25 on tension bolt 23 onto plate member 24 causes the plate member 24 to move downwardly over the shell 20 simultaneously forcing the supporting hoop 13 downwardly and stretching the MYLAR® which constitutes the drumming surface 10 over the top 19 of the shell 20. As the pressure increases on the tension increasing material 30 its shape is distorted to the flatter shape and the transverse extension of the ring 31 increases the tension on the skirt 21 of the drumming surface material whereby the tension of the drumming surface material is increased relatively substantially. As illustrated in FIG. 3 the skirt 21 is forced closer to the outer perimeter of shell 20 than in the relatively less tensioned state as illustrated in FIG. 2.

The O-ring 30 may completely surround the skirt 21 of the drumming surface or may at least partly surround the drumming surface. The O-ring material is selected from a linear polyethelyne, a polypropelyne or neoprene or other similar materials having a hardness between 50 Duro and 100 Duro. Preferably the hardness is substantially 70 Duro. The material is obtained by heat treating and thereby increasing a basic Duro of 40 to the preferred Duro level.

Where the mechanism of the invention is utilized in a high-tension drumhead, the tension on the drumming surface material is increased to a range of 500 psi to 8,000 psi and is preferably greater than 1000 psi.

The ring material 30 can be constituted by an elongated strip which is cut substantially to form the shape of a ring about the skirt 21 of the drumming surface material. Alternatively the ring material can be formed as an O-ring. The O-ring adheres to the outside surface of the drumming material or to the top of the epoxy 15 or the lip of the metal hoop 13 at its mouth. Adhering the O-ring to the drumming surface material secures the position of the O-ring relative to the drumming surface.

In yet another preferred form of the invention the O-ring material can be fused into adherence with the drumming surface material and the epoxy, and in some cases can be an extension of the epoxy means beyond the mouth of the supporting hoop.

By this invention there is obtained a high compressionable drumhead which can be built into the manufacture of the drumhead or added as a supplementary step to existing drumheads. In the placing, attachment and tuning of the drumhead prior to playing or for use in the fashion needed by the musician the instrument can give off the requisite sound.

The O-ring material is rubberized and is a butyl, neoprene or ethelyne based material with plasticisers added to establish flexibility. The construction of the material is such that the compressionable strength is from 1 psi to 1000 psi for direct or bidirectional compression.

In tensioning the drumhead, the tensioning pressure is applied so as to not break down the ability of the tension increasing material 30 to seal in the epoxy, thereby preventing it form escaping between the hoop means and the drum shell, nor to damage the elasticity of the tension increasing material, thereby causing the release of drumhead tension or a loss of the desired sound quality of the present invention.

Thus, as can be seen in FIGS. 2 and 3, a high tension drum according to the present invention has a drum shell 20, a flesh hoop generally designated as 100, a counterhoop generally designated as 101, a drum head generally designated as 102 having a drumming surface 10 and a segment or skirt 21 located between the flesh hoop 100 and a top edge 19 of the drum shell 20, a tensioning means generally depicted as 103 for applying a tensioning force substantially perpendicualr to the drumming surface 10 toward the flesh hoop 100 to the counterhoop 101, the tensioning means being affixed to the drum shell 20 by a support structure 22 and in contact with the counterhoop 101, and an elastomeric O-ring or tensioning increasing material 30 located between the flesh hoop 100 and the counterhoop 101 which applies a lateral force radially inwardly around the drum shell 20 on the skirt or segment 21 wherein the laterial force is part of a triangle of forces consisting of the tensioning force applied to the counterhoop 101, the lateral force and resistance to stretching by the segment or skirt 21, the tension increasing material having a substantially. circular cross-section in an untightened position as shown in FIG. 2 and a flatter cross-section in a tightened position as shown in FIG. 3. In the particular embodiment shown in FIGS. 2 and 3, the tensioning means 103 is comprised of a plurality of tensioning bolts 23 in contact with the counterhoop 101 as described above.

While alternative embodiments of the present invention have been illustrated and described, it will be apparent to those skilled in the art that many variations and modifications thereof may be made without departing from the teachings herein, and it is intended that all such variations and modifications be encompassed within the scope of the appended claims.

We claim:

1. A high tension drum, comprising:

a drum shell;

a flesh hoop;

a counter-hoop;

a drumhead having a drumming surface and a segment located between the flesh hoop and a top edge of the drum shell;

tensioning means for applying a tensioning force substantailly perpendicular to the drumming surface toward the flesh hoop to the counterhoop, said tensioning means being affixed to the drum shell and in contact with the counterhoop; and an elastomeric O-ring located between the flesh hoop and counter-hoop which applies a lateral force radially inwardly around the drum shell on the segment wherein the lateral force is part of a triangle of forces consisting of the tensioning force, said lateral force and resistance to stretching by the segment of the drumhead.

2. A drum as in claim 1 wherein the drumming surface has a tension of 500 psi or greater.

3. A drum as in claim 1 wherein the elastomeric O-ring has a hardness between 50 Duro and 100 Duro.

4. A drum as in claim 1 wherein the elastomeric O-ring is constituted by a cylindrical elongated strip which is cut substantially to form the shape of a ring for location about the perimeter of the drumhead.

5. A high tension drum, comprising:

a drumhead; said drumhead having a planar drumming surface, a skirt and a free end, said skirt being bent downwardly from the planar durmming surface at a top edge of the drum shell to terminate in the free end, said drumhead being in substantially circular contact with the drum shell about the top edge of said drum shell;

an epoxy means;

a substantially circular flesh hoop located about the drum shell, said flesh hoop having a substantially circular slot with an open mouth, said epoxy means being located in the slot and substantially surrounding the free end of the drumhead;

a counter hoop;

a tensioning means for applying a tensioning force to the counter hoop in a direction substantially perpendicular to the planar drumming surface toward the flesh hoop; and a tension increasing material located between the flesh hoop and the counterhoop which applies a lateral force radially inwardly around the drum shell on the skirt wherein the lateral force is part of a triangle of forces consisting of the tensioning force applied to the counter hoop, the lateral force and resistance to stretching by the skirt, said tension increasing material having a substantially circular cross-section in an untightened position and a flatter cross-section in a tightened position.

6. A high tension drum as recited in claim 5 wherein the drumming surface has a tension of 500 psi or greater.

7. A high tension drum as recited in claim 6 wherein the tension increasing material is an O-ring with a hardness between 50 Duro and 100 Duro.

8. A high tension drum as recited in claim 5 wherein the tension increasing material is adhered to the epoxy means.

9. A high tension drum as recited in claim 5 wherein the tension increasing material is adhered to the skirt.

10. A high tension drum as recited in claim 5 wherein the tension increasing material is deformed over the mouth of the flesh hoop in the tightened position.

11. A high tension drum as recited in claim 5 wherein the tensioning means is comprised of a plurality of tensioning bolts in contact with the counter hoop.

* * * * *